United States Patent [19]

Rossmann et al.

[11] 4,375,233

[45] Mar. 1, 1983

[54] METHOD OF MAKING A TURBINE BLADE HAVING A METAL CORE AND A CERAMIC AIRFOIL

[76] Inventors: Axel Rossmann, Bachweg 4; Werner Huther, Nikolaus-Lenau-Strasse 8, both of Karlsfeld, Fed. Rep. of Germany, 8047

[21] Appl. No.: 198,978

[22] Filed: Oct. 21, 1980

[30] Foreign Application Priority Data

Nov. 10, 1979 [DE] Fed. Rep. of Germany ..... 2945531

[51] Int. Cl.[3] ..... B22D 19/02

[52] U.S. Cl. ..... 164/9; 164/35; 164/75; 164/98

[58] Field of Search ..... 164/34, 35, 75, 98, 164/100, 122.1, 9

[56] References Cited

U.S. PATENT DOCUMENTS

| | | | |
|---|---|---|---|
| 3,863,701 | 2/1975 | Niimi et al. | 164/98 |
| 4,154,282 | 5/1979 | Kull | 164/34 X |
| 4,291,741 | 9/1981 | Willem | 164/75 X |

FOREIGN PATENT DOCUMENTS

| | | | |
|---|---|---|---|
| 736948 | 7/1943 | Fed. Rep. of Germany . | |
| 898883 | 9/1952 | Fed. Rep. of Germany . | |
| 2017550 | 10/1979 | United Kingdom | 164/38 |

*Primary Examiner*—Gus T. Hampilos
*Attorney, Agent, or Firm*—Alan H. Levine

[57] ABSTRACT

A finished ceramic airfoil is provided having within it a lining of thermal insulation and a fusible core having the desired contour of the metal core of the turbine blade. A casting mold is provided around the airfoil. The fusible core is melted and removed, leaving a cavity in the airfoil surrounded by the insulation lining. The cavity is filled with molten metal which is allowed to solidify to form the metal core of the turbine blade.

12 Claims, 1 Drawing Figure

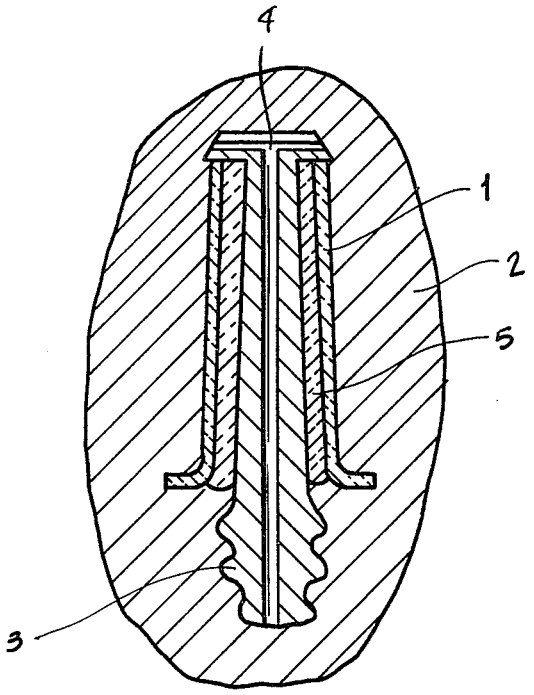
4
1
2
5
3

METHOD OF MAKING A TURBINE BLADE HAVING A METAL CORE AND A CERAMIC AIRFOIL

This invention relates to a method of making a hot gas contacted turbine blade having a metal core and a ceramic airfoil.

Such metal-core supported ceramic blades come in a great variety of constructions, such as shown, e.g., in German Pat. No. 736,958 and German Pat. No. 848,883. In turbine blades of this description, the ceramic airfoil normally rests in the blade tip area, in a radially outward direction on an internal metal core such that centrifugal forces are transferred to the rotor disc through the metal core. Since the load-bearing head of the metal core, and normally also its root, is necessarily larger in section than the free section of the ceramic airfoil, the ceramic airfoil cannot be slipped on to the metal core from the head or root end of the core. Rather, the metal core must be a two-piece construction, or else the metal core is subsequently shaped to give the head a wider section, as perhaps by upsetting, welding, or attaching the head member by brazing, welding, or other joining process. The soundness of the resulting joint will then be difficult to ensure, or the joints will exhibit deficient mechanical strength, or the ceramic airfoil may be damaged when the metal core is being shaped. Another problem encumbering such turbine blades having a metal core and ceramic airfoil is that of achieving positively uniform support of the ceramic airfoil on the head of the metal core, which support must be ensured to preclude local stress peaks in the ceramic material and the attendant risk of fracture.

It is a broad object of the present invention to provide a simple method of manufacturing a hot gas contacted turbine blade of the type described which is suitable for use even though subjected to mechanical and thermal loads.

It is a particular object of the present invention to provide a method wherein the metal core is formed in the ceramic blade, inseparably therewith, by a casting process.

A turbine blade made in accordance with the present invention gives optimum bearing support for the ceramic airfoil on the metallic core, preferably the core head, since the contour of the metallic core is mated to that of the ceramic airfoil when the metal is in its liquid phase. A further advantage afforded by a turbine blade designed in accordance with the present invention is that any risk of damage to the ceramic airfoil, or of insecure attachment caused by a joining operation in the blade tip area, is precluded. Use is made of time-tested casting technology in its known, unaltered form, which is an essential benefit from the manufacturing aspect.

A further advantage provided by a method according to the invention results from the fact that owing to the greater shrinkage of the metal core during solidification and cooling, a gap is formed between the ceramic airfoil and the metal core, the gap enhancing the thermal insulation of the metal core. Ultimately, the metallic core can be provided with simple cored cooling passages, so that the entire cooling configuration of a turbine blade in accordance with the present invention can be produced with no additional effort.

In a preferred embodiment of the present invention, a highly elastic thermal insulation layer is inserted between the ceramic airfoil and the metal core. The insulation layer minimizes heat transfer from the airfoil to the blade core by preventing the radiation of heat from the airfoil to the core and by additionally obstructing the conduction of heat. The high elasticity of the insulation layer serves to cushion impact loads between the airfoil and the blade core.

Ceramic materials preferred for use in making turbine blades according to the present invention are hot pressed or reaction sintered $Si_3N_4$, SiC, or Si infiltrated SiC.

When selecting the material for the insulation layer it should be remembered that chemical reactions between the insulation layer and the ceramic airfoil or the metal core, during the casting process and also at service temperatures, should be prevented. The insulation layer, therefore, should preferably consist of a felt-like deposit of $Al_2O_3$ or ZrO slurry. Use can also be made of foamed ceramic materials or ceramic materials filled with small hollow spheres. Also suitable for use as an insulation layer are thermally poorly conductive ceramic materials, such as aluminium titanate, magnesium aluminium silicate, and lithium aluminium silicate.

A method of manufacturing a turbine blade according to the invention includes the following sequence of process operations:

(a) A finished ceramic airfoil, which is lined with thermal insulation and surrounds a fusible core (made for example of wax) having the contour of a subsequent metal core, is placed in a casting mold, or a casting mold is formed over the ceramic airfoil by repeatedly dipping the component in a ceramic slip, (b) The fusible core is removed by melting it out, and (c) The resulting cavity is filled with cast metal which is permitted to harden into the metal core of the turbine blade.

In the process, the manufacture of the finished airfoil can optionally be selected such that the ceramic airfoil is a hollow shape to start with, into which, by way of a preforming mold, the fusible material is poured. The approach can also be reversed, however, by first making the fusible core and then forming the ceramic airfoil over it by slip casting process.

In order to manufacture a turbine blade having an insulation layer between the metal core and the ceramic airfoil, an insulation layer must be inserted between the fusible core and the ceramic airfoil. The insulating layer will adhere to the inner walls of the ceramic airfoil when the fusible core is removed by fusing, and it will be enclosed between the metal core and ceramic airfoil when the casting metal is poured.

The accompanying drawing, illustrating the arrangement of a turbine blade made in accordance with the present invention, is a longitudinal sectional view through such a blade within a mold.

In the drawing, the ceramic airfoil is indicated by the numeral 1, and the metal core with its widened head and fir tree root by the numeral 3. The airfoil 1 projects in a radially outward direction from the head of the metal core 3. Cast into place between the ceramic airfoil 1 and the blade core 3 is an insulation layer 5. The blade core 3 has cooling passages 4. The entire blade is shown embedded in an investment casting mold 2.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A method of making a turbine blade having a metal core and a ceramic airfoil, comprising the steps of (a) providing a finished ceramic airfoil having within it I. a lining of thermal insulation material of high elasticity, and II. a fusible core having the desired contour of the metal core, (b) providing a casting mold around the ceramic airfoil, (c) melting and removing the fusible core from the ceramic airfoil to leave a cavity within the airfoil surrounded by the insulation lining, (d) filling the cavity with a molten metal, and (e) allowing the molten metal to solidify to form the metal core of the turbine blade.

2. A method as defined in claim 1 wherein the fusible core is formed by pouring molten fusible material in the finished hollow ceramic airfoil.

3. A method as defined in claim 1 wherein the ceramic airfoil is formed over the premade fusible core.

4. A method as defined in claim 1 wherein the ceramic airfoil is placed into a pre-existing casting mold.

5. A method as defined in claim 1 wherein the casting mold is formed over the ceramic airfoil by repeatedly dipping the airfoil in a ceramic slip.

6. A method as defined in claim 1 wherein the airfoil is formed of $Si_3N_4$, SiC, or Si infiltrated SiC.

7. A method as defined in claim 1 wherein the insulation layer is formed of a felt-like deposit of $Al_2O_3$ slurry.

8. A method as defined in claim 1 wherein the insulation layer is formed of a felt-like deposit of ZrO fiber slurry.

9. A method as defined in claim 1 wherein the insulation layer is formed of foamed ceramic material.

10. A method as defined in claim 1 wherein the insulation layer is formed of ceramic material filled with small hollow spheres.

11. A method as defined in claim 1 wherein the insulation layer is formed of poor-heat conductive ceramic material.

12. A method as defined in claim 11 wherein the ceramic material of the insulation layer is selected from the class consisting of aluminum titanate, magnesium aluminum silicate, and lithium aluminum silicate.

* * * * *